US005259319A

United States Patent [19]

Dravecky et al.

[11] Patent Number: 5,259,319

[45] Date of Patent: Nov. 9, 1993

[54] REUSABLE TRAINING AMMUNITION

[76] Inventors: Richard Dravecky, 5861 Cherrywood Dr., Boardman, Ohio 44512; Joseph Dravecky, 2085 Elm Trace, Austintown, Ohio 44515; Frank G. Dravecky, Jr., 3167 Paradise La., Canfield, Ohio 44406; John G. Nichols, 865 Trailwood Dr., Boardman, Ohio 44512

[21] Appl. No.: 855,229

[22] Filed: Mar. 20, 1992

[51] Int. Cl.[5] ..... F42B 8/02

[52] U.S. Cl. ..... 102/447; 102/439; 102/444; 102/529

[58] Field of Search ..... 102/430, 439, 444, 446, 102/447, 502, 527, 529

[56] References Cited

U.S. PATENT DOCUMENTS

| | | | |
|---|---|---|---|
| 700,983 | 5/1902 | Scruggs | 102/439 |
| 1,861,522 | 6/1932 | Brandt . | |
| 1,902,771 | 3/1933 | Gaidos | 102/446 |
| 2,541,025 | 2/1951 | Bluford et al. | 89/29 |
| 2,793,590 | 5/1957 | Brandt | 102/41 |
| 2,857,812 | 10/1958 | Nichols | 89/29 |
| 3,058,420 | 10/1962 | Tanner et al. | 102/439 |
| 3,060,856 | 10/1962 | Dunn | 102/446 |
| 3,147,708 | 9/1964 | Ferguson | 102/41 |
| 3,237,335 | 3/1966 | Kerr | 42/8 |
| 3,805,702 | 4/1974 | Voss et al. | 102/38 |
| 3,901,158 | 8/1975 | Ferb | 102/529 |
| 3,983,817 | 10/1976 | Tucker | 102/41 |
| 4,008,665 | 2/1977 | Gawlick et al. | 102/41 |
| 4,164,904 | 8/1979 | Laviolette | 102/92.7 |
| 4,233,902 | 11/1980 | Hartley et al. | 102/41 |
| 4,470,604 | 9/1984 | Hoffmann | 102/529 |
| 4,682,545 | 7/1987 | Jett, Jr. | 102/430 |
| 4,850,278 | 7/1989 | Dinkha et al. | 102/501 |
| 4,860,661 | 8/1989 | Bock et al. | 102/523 |
| 4,969,397 | 11/1990 | Gunther et al. | 102/233 |
| 4,986,186 | 1/1991 | LaRocca et al. | 102/430 |
| 5,001,986 | 3/1991 | Meister | 102/529 |
| 5,016,536 | 5/1991 | Brighton | 102/430 |
| 5,086,703 | 2/1992 | Klein | 102/444 |

FOREIGN PATENT DOCUMENTS

| | | | |
|---|---|---|---|
| 705346 | 4/1941 | Fed. Rep. of Germany | 102/430 |
| 15298 | 8/1892 | United Kingdom | 102/444 |
| 2223084 | 3/1990 | United Kingdom | 102/469 |

OTHER PUBLICATIONS

No. 14 Liquid Filled Barricade Projectile CN,CS and Practice (2 page advertis.) Def-Tec Corporation, Rock Creek, Ohio 44084 (believed to be 1990 or before).

(List continued on next page.)

*Primary Examiner*—Harold J. Tudor
*Attorney, Agent, or Firm*—David A. Burge

[57] ABSTRACT

A reusable "training" or "practice" round has a reusable hollow casing and a reusable hollow projectile that "snap together" and are releasably retained in assembled relationship by utilizing a resilient connecting member such as a groove-carried O-ring that is interposed between juxtaposed surfaces of concentrically interfitting portions of the casing and the projectile. The assembled practice round is inserted into the chamber end region of the barrel of a firearm and, when the round is fired, the casing is retained in the chamber as the projectile is caused to move along the barrel of the firearm and to discharge along a trajectory that closely simulates the path of flight of a "live" round. Propellant is provided by a reloadable or disposable blank-type cartridge. The projectile and the casing have hollow interiors that communicate and cooperate to define a closed chamber into which the blank round is fired to explosively generate the force needed to rapidly disconnect the projectile from the casing and to launch the projectile through the barrel of the firearm. A snap-together type of releasable connection is established between the casing and the projectile 1) by providing the casing and the projectile with coaxially extending surfaces that are brought into juxtaposed relationship during assembly of the casing and the projectile, and 2) by positioning a resilient connecting member to be tightly clamped between the juxtaposed surfaces just as assembly of the round is completed.

11 Claims, 4 Drawing Sheets

OTHER PUBLICATIONS

No. 17 Long and Short Range Projectile CN,CS and Smoke (2 page advertisement) Def-Tec Corporation, Rock Creek, Ohio 44084 (believed to be 1990 or before).

No. 19 Multiple Projectile Round CN,CS and Smoke (2 page advertisement) Def-Tec Corporation, Rock Creek, Ohio 44084 (believed to be 1990 or before).

No. 20 Wood No. 20 Foam Multiple Baton Round (2 page advertisement) Def-Tec Corporation, Rock Creek, Ohio 44084 (believed to be 1990 or before).

No. 21 Muzzle Blast Dispersion CN, CS and Practice (2 page advertisement) Def-Tec Corporation, Rock Creek, Ohio 44084 (believed to be 1990 or before).

No. 1315 Shoulder Gas Gun 37/38 mm 1.5-inch Caliber (2 page advertisement), Def-Tec Corporation, Rock Creek, Ohio 44084 (believed to be 1990 or before).

M-203PI Product Improved 40 mm Grenade Launcher System (2 page advertisement) R/M Equipment, Miami, Fla. 33166 (bears copyright date of 1989).

No. 12 Heavy Barricade Projectile CN,CS and Smoke (2 page advertisement) Def-Tec Corporation, Rock Creek, Ohio 44084 (believed to be 1990 or before).

REUSABLE TRAINING AMMUNITION

BACKGROUND OF THE INVENTION

1. Field of the Invention

The present invention relates generally to the provision of a reusable "training" or "practice" round of ammunition that includes a reusable hollow casing, a reusable hollow projectile, and a reusable resilient connecting medium for releasably retaining the casing and projectile in assembled configuration until the round is chambered and fired. In preferred practice, the casing and the projectile have interfitting connecting portions that define coaxially extending surfaces that are brought into juxtaposition just as the assembly of the casing and the projectile are completed; and, the resilient connecting medium takes the form of a groove-mounted O-ring that is tightly clamped between the juxtaposed surfaces during assembly of the round. An optional aspect of the invention relates to the provision of one or more groove-carried O-rings that extend circumferentially about outer surface portions of the projectile of a practice round for engaging barrel rifling formations to impart spin to a fired projectile.

2. Prior Art

During the training of law enforcement and military personnel to fire 37 mm and 40 mm weapons of the type known as "gas guns" and "grenade launchers," it is desirable to minimize ammunition cost and attendant danger by using "training" or "practice" rounds rather than "live" ammunition during demonstration and practice firings of "these relatively large-bore guns. By practice-firing training rounds, personnel can become familiar with operation of the weapons; and, to the extent that the projectiles of training rounds are capable of properly simulating flight characteristics of live ammunition, proficiency can be developed in aiming and firing the weapons.

Because presently available training rounds for use with 37 mm and 40 mm weapons characteristically are neither inexpensive nor repeatedly reusable, the relatively high cost of training ammunition often stands as an obstacle to providing personnel who need to be proficient in the use of these weapons with frequent, regularly scheduled opportunities to practice-fire the weapons. Because many police departments have severely limited budgets for purchasing training rounds for large bore weapons, it often is the case that even those personnel who once had training in the use 37 mm and 40 mm weapons have not been provided with adequate opportunities to maintain their proficiency with these weapons by participating in regular, repeated target practice of the type that typically is needed to attain and maintain proficiency.

Another problem that often is encountered when utilizing training or practice rounds is that the materials from which the rounds are formed fail to provide projectiles that, when launched, properly simulate the flight trajectory and range of a live round. Thus, to the extent that training is conducted utilizing training rounds, often such training is not adequately realistic to permit personnel to become proficient in firing live rounds.

Still another problem that is encountered with present-day training ammunition is that, even when training rounds are intended to be "reusable," in actual practice one or more component parts of the rounds are found to crack, shatter or otherwise be rendered unusable after only a few firings. In many instances, so-called "reusable" training rounds break after only a single firing. Thus, there has been a long-standing need for training rounds formed from durable components that are repeatedly reusable, that properly simulate the flight characteristics of a live round of ammunition, and that can be repeatedly reused at a low cost per practice firing.

In concluding this discussion of present-day practices and other relevant aspects of the "prior art," it is desirable to briefly mention two additional topics. One has to do with the provision of ammunition with so-called "spin bands" for use with weapons having "rifled" barrels The other has to do with the limited use that has been made, to date, of so-called "O-rings" in the design and construction of ammunition.

It is known to provide rounds of ammunition with one or more rings of soft metal known as "spin bands" that engage rifling within the barrel of a weapon to impart spin to a fired projectile. Typically, such bands are formed from lengths of soft metal such as lead. Mounting portions of the bands typically are crimped into grooves that extend circumferentially about projectiles. When the projectiles are fired, the bands tend to be distorted as they are forced into engagement with barrel rifling. Present-day spin bands tend not to be reusable.

It also is known to utilize O-rings as component parts of various forms of ammunition. However, the function commonly performed O-ring components of ammunition is to provide fluid-tight "seals" between or among adjacently positioned components. The use of O-rings to provide seals does not teach or suggest the very different, nonconventional uses to which resilient O-rings are put in accordance with various aspects of the preferred practice of the present invention, as those who are skilled in the art readily will appreciate.

SUMMARY OF THE INVENTION

The present invention addresses the foregoing and other drawbacks of the prior art by providing a novel and improved reusable training round.

In accordance with one aspect of the present invention, a reusable "training" or "practice" round is formed as an assembly of a durable, reusable casing and a durable, reusable projectile, which components are releasably retained in assembled relationship by virtue of a resilient connecting medium that is tightly compressed therebetween. In preferred practice, the resilient connecting medium takes the form of a commercially available O-ring.

In accordance with an optional aspect of the present invention, the projectile of a round of ammunition (such as a reusable "training" or "practice" round) has at least one circumferentially extending groove within which is seated at least one endless ring of resilient material. The seated, circumferentially extending ring or rings of resilient material each serve as a "spin ring" to engage rifling within the bore of a gun barrel to impart spin to the projectile when it is launched through the barrel. In preferred practice, the resilient ring or rings each take the form of a commercially available O-ring.

In accordance with still another aspect of the present invention, a reusable training round is provided that is particularly well suited for use with relatively large bore weapons such as 37 mm gas guns and 40 mm grenade launchers that are used to fire gas-dispensing ammunition and the like. Very durable reusable projectile and casing components are formed from impact-resistant material that will resist breakage and deformation throughout large numbers of typical practice firings. While fiber reinforced impact-resistant plastics may be employed, in the preferred practice of the present invention both the reusable projectile and the reusable casing are formed from corrosion resistant metal, preferably a lightweight metal such as aluminum.

Inasmuch as 37 mm gas guns are "smooth bore" weapons, 37 mm training rounds that incorporate features of the present invention typically employ resilient rings such as commercially available O-rings only as a connecting medium to releasably retain reusable projectiles in assembled relationship with reusable casings. Inasmuch as 40 mm grenade launchers are "rifled bore" weapons, 40 mm training rounds that incorporate features of the present invention typically employ resilient rings such as commercially available O-rings both in the aforedescribed role as a connecting medium and to provide groove-carried spin bands that extend circumferentially about reusable projectiles for engaging barrel rifling to impart spin to the projectiles when they are launched through a rifled 40 mm barrel.

A feature of the use of commercially available O-rings seated in grooves formed in reusable projectiles of reusable training rounds is that the O-rings are retained in their mounting grooves during firings of the training rounds, travel with the reusable projectiles, and typically survive many firings before requiring replacement. Furthermore, when replacement of one or more of the O-rings is required, it can be attended to at low cost (commercially available O-rings are relatively inexpensive) and can be carried out quickly and easily (simply by slightly stretching each resilient O-ring by sliding it along outer surface portions of the reusable projectiles so that damaged O-rings are removed from their mounting grooves and replacement O-rings are seated therein—a procedure that usually can be performed without special tools and without a need for specially trained personnel).

In preferred practice, both the reusable projectile and the reusable casing have hollow interiors. The reusable projectile preferably is machined from aluminum, and is of relatively thin-walled tubular design except for nose portions of the projectile which preferably take the form of a solid, blunt-nosed mass of aluminum. The casing preferably is machined from aluminum and has a relatively thin-walled forward end region which defines a forwardly-facing opening for receiving and nesting therein a rearwardly projecting portion of the projectile. Rear portions of the casing are thick-walled and serve to reinforcingly surround a center bore that is configured to snugly receive a blank-type propellant cartridge.

In preferred practice, hollow interior portions of the projectile and the casing are brought into communication when the projectile and the casing are assembled. The communicating hollow interiors cooperate to define a closed chamber into which a blank round of ammunition is fired to explosively generate the force needed to rapidly disconnect the projectile from the casing and to launch the projectile through the barrel of a gun.

In preferred practice, an effort is made to assure that the projectile is configured to facilitate its exhibiting the good flight characteristics of a live round—and, at the same time, an effort is made to assure that the projectile is sufficiently strong to withstand repeated firings without sustaining debilitating damage. In so forming the projectile, efforts are made to assure that outer and inner surfaces of the projectile are symmetrical about an imaginary center axis of the elongate projectile, and that even the relatively thin tubular portions of the projectile are sufficiently thick to resist deformation and breakage upon impact. The configurations of the reusable training round components that are illustrated in the drawings represent the best mode presently known to the inventors for carrying out the preferred practice of the present invention. A number of features of these configurations will be discussed in the detailed description that follows later herein.

In preferred practice, still other features result from carefully selecting the position that is to be occupied by an O-ring that is to serve as a connecting medium between a reusable projectile and a reusable casing of a reusable training round. Preferably, an O-ring that performs such a connecting function is positioned so as to *not* be compressively clamped between coaxially extending tubular portions of the projectile and the casing *until* the assembly movement of these components is nearly completed By positioning a connecting O-ring so as to be compressively clamped *only* when a nestable projectile and casing are *nearing completion* of such relative movement as is needed to effect their assembly, the connecting O-ring is subjected to a minimal amount of wear. Because the range of travel through which the juxtaposed surfaces that lamp the O-ring are permitted to move is quite limited when the components that are being assembled have nearly reached their fully assembled positions, such wear as is experienced by the O-ring (due to its being clamped between oppositely moving juxtaposed surfaces) is minimized; and, this holds true both during assembly (when the juxtaposed surfaces that clamp the O-ring are moved relative to each other in one direction), and during firing of the round (when the juxtaposed clamping surfaces are moved relative to each other in the opposite direction).

Still another advantage results from the aforedescribed positioning of the groove-carried O-ring that serves as a connecting member, namely the advantage that resides in providing the desirable "feel" of establishing a secure "snap together" type of connection as the projectile and the casing are manually moved to their fully assembled position—a feature that will be better understood from the explanation that follows.

As those who are skilled in the art will appreciate, when a groove-carried O-ring that extends circumferentially about an elongate, axially-extending first component is to be radially inwardly compressed by axially moving a tubular second component into coaxial surrounding relationship with the first component, an end surface of the tubular second component is what initially engages such portions of the O-ring as extend radially outwardly from the groove in which the O-ring is seated. When the end surface of the tubular second component first makes contact with the O-ring, the material of the O-ring has not been radially inwardly compressed; rather, a substantial mass of O-ring material is positioned squarely in the path of axial movement of the tubular second component and serves to block further axial movement of the second component.

To complete the assembly movement of the second component relative to the first component, it is necessary to increase the assembly force that is being applied to effect relative axial movement of the first and second components. As assembly force is increased, the material of the O-ring is caused 1) to resiliently change its cross-section as it slides into the interior of the tubular second component, and 2) to be compressed radially inwardly by virtue of its engagement with the interior of the tubular second component. As the tubular second component progressively forces material of the O-ring into its interior, progressively less material of the O-ring is left to block the path of relative movement of the tubular second component across the location of the groove-carried O-ring; and, there comes a time when the relatively large assembly force that is being applied to the second component overwhelms the diminishing resistance that is offered by the progressively diminishing amount of O-ring material that blocks the path of the second component.

When resistance to axial movement of the tubular second component (that had been offered by the presence of O-ring material obstructing the path of movement of the second component) suddenly abates, the substantial assembly force that still is being applied to the second component causes the tubular second component to effect snap-action movement into its final assembled position. When fully assembled, an end wall of the tubular second component strikes a radially extending shoulder formed on the first component. The resulting effect (that a person who is manually assembling the two components senses) is very much the same kind of "feel" that is provided by when two components are securely "snap-connected" by any of a variety of commercially available snap-action connectors.

BRIEF DESCRIPTION OF THE DRAWINGS

The foregoing and other features of the invention will be better understood by referring to the description of the preferred embodiment and the claims which follow, taken together with the accompanying drawings, wherein:

DESCRIPTION OF THE PREFERRED EMBODIMENT

Figure 1:
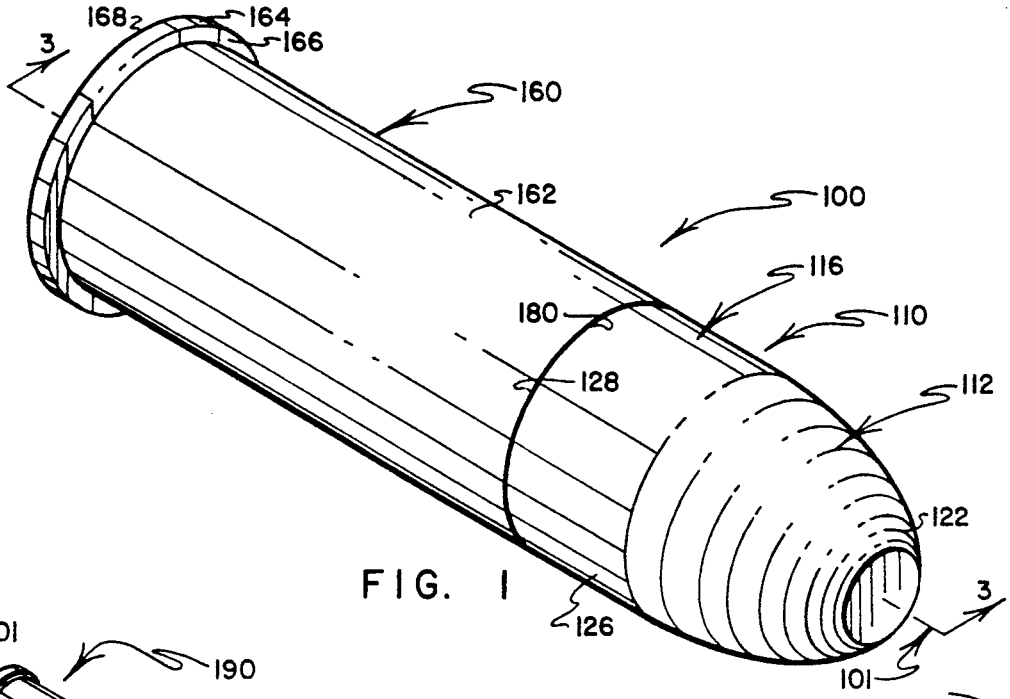
FIG. 1 is a perspective view of a round of reusable training ammunition that embodies features of the preferred practice of the present invention.

Referring to FIGS. 1–5, a first embodiment of a training round that incorporates features of the preferred practice of the present invention is indicated generally by the numeral 100. Referring to FIGS. 6–10, a second embodiment of a training round the incorporates features of the preferred practice of the present invention is indicated generally by the numeral 200.

Because many of the features of the embodiments 100, 200 equivalently correspond in the sense that they utilize much the same structure for performing substantially identical functions, corresponding features of the embodiments 100, 200 are indicated by numerals that differ by a magnitude of one hundred. Thus, for example, the training rounds 100, 200 have reusable projectiles that are designated generally by the numerals 110, 210, reusable casings 160, 260, reusable connecting O-rings 150, 250, and propellant cartridges 190, 290, respectively.

Figure 2:
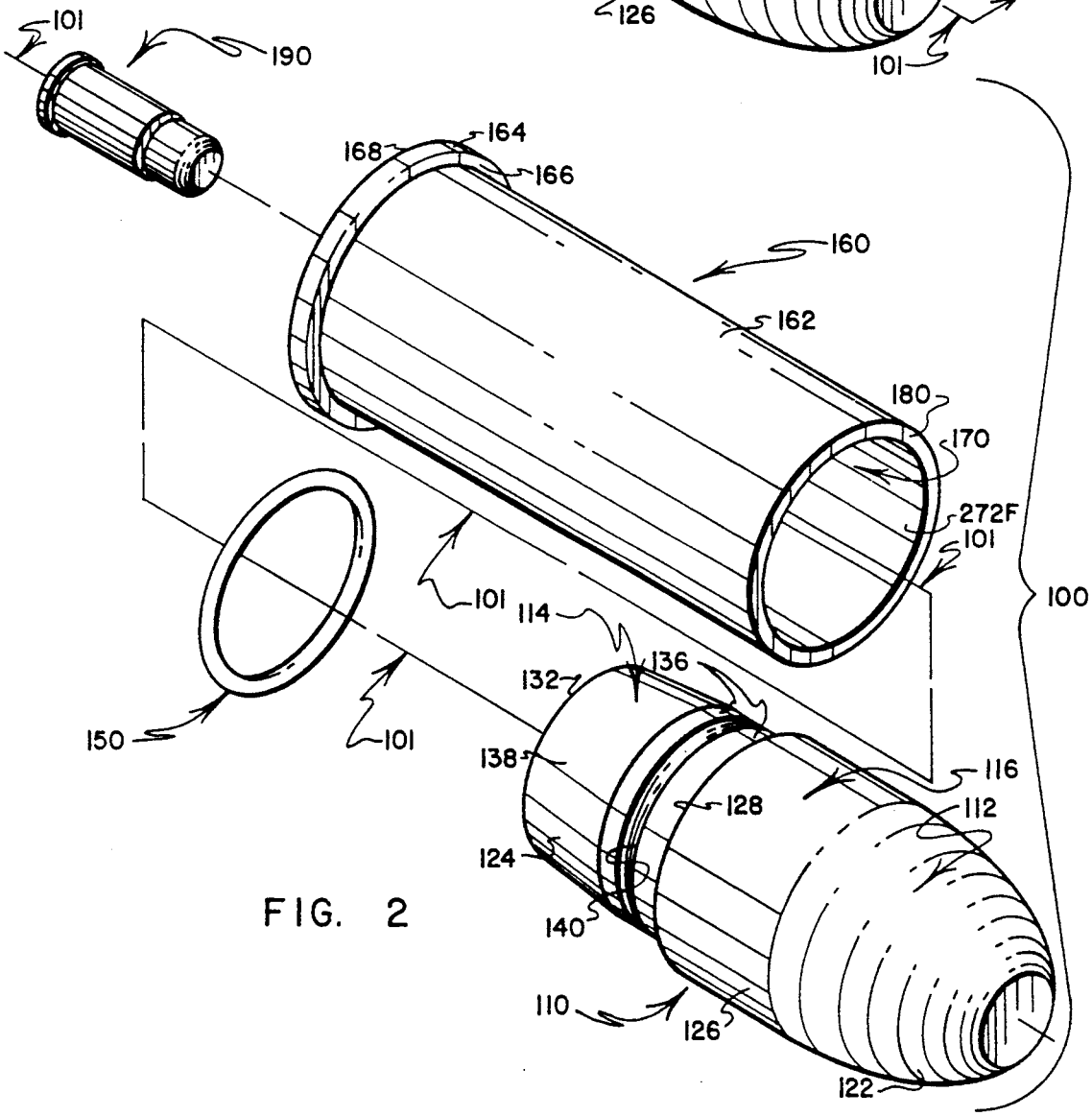
FIG. 2 is an exploded perspective view showing features of the components parts thereof including a reusable projectile, a reusable casing, a reusable O-ring and a propellant cartridge.
Figure 4:
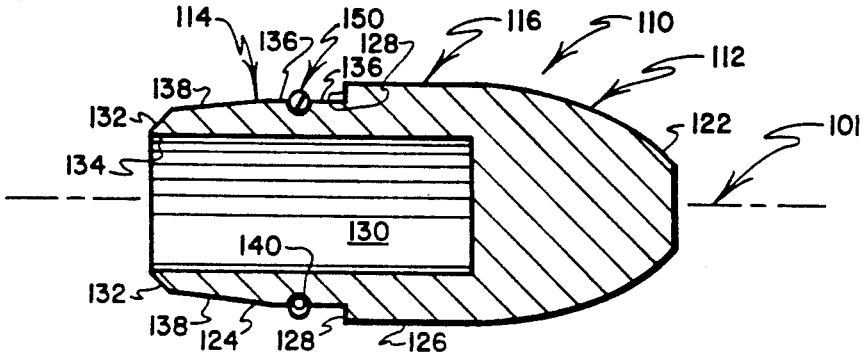
FIG. 4 is a sectional view of the reusable projectile.
Figure 7:
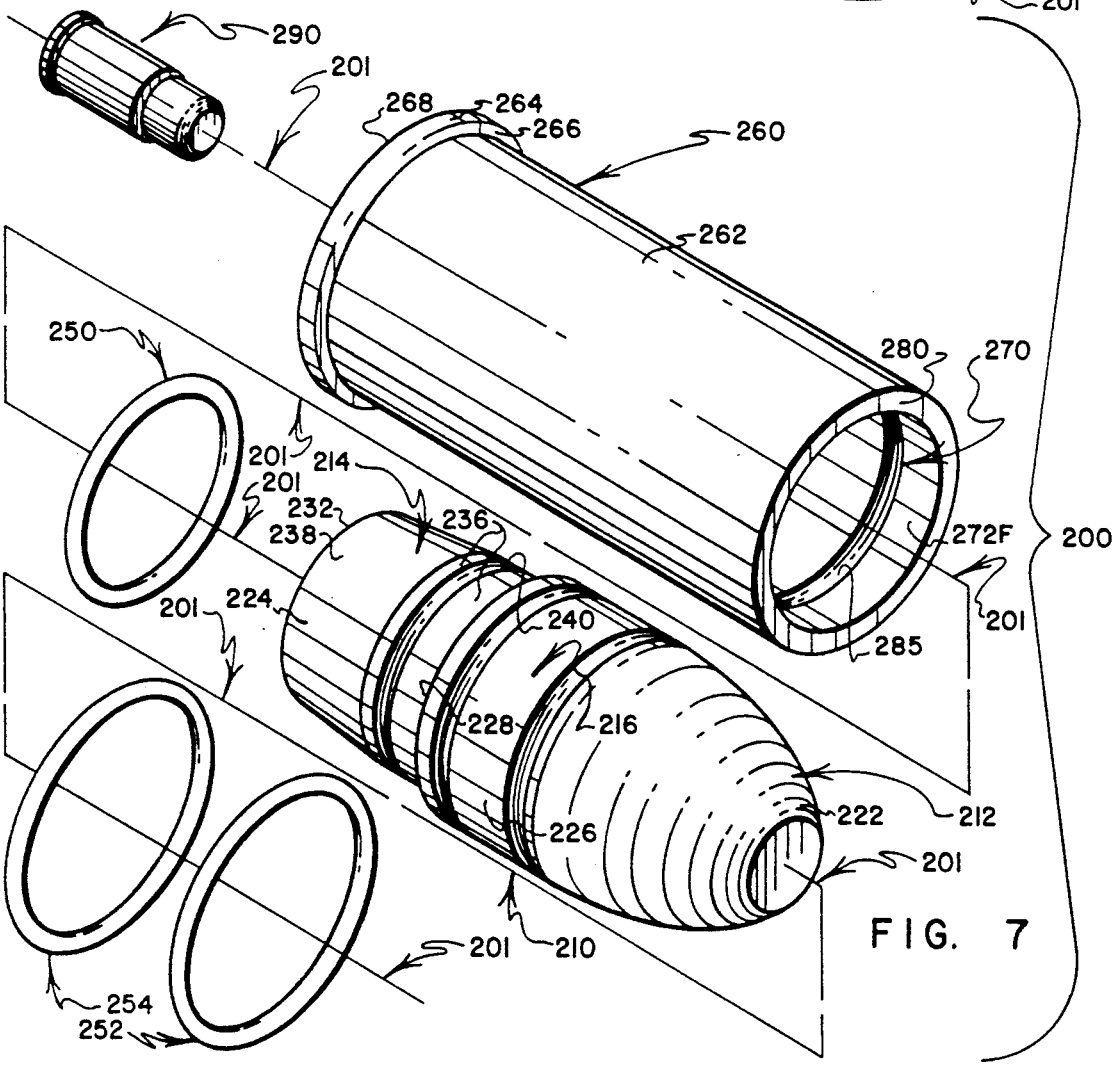
FIG. 7 is an exploded perspective view showing features of the components parts of the embodiment of FIG. 6 including a reusable projectile, a reusable casing, reusable O-rings and a propellant cartridge.
Figure 9:
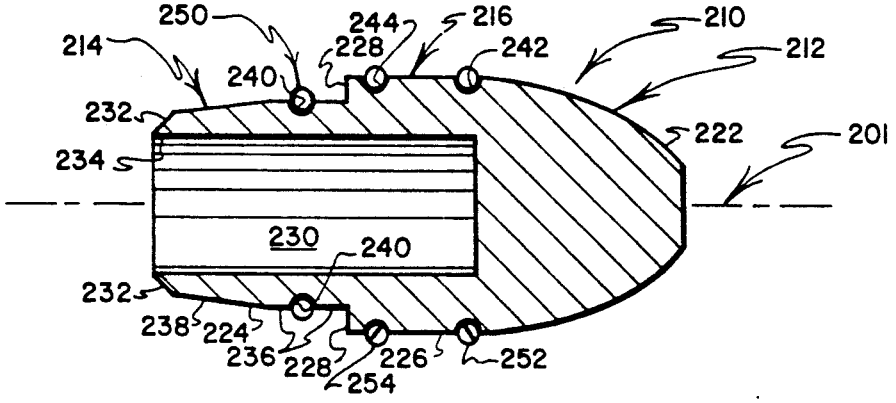
FIG. 9 is a sectional view of the reusable projectile of FIGS. 6–8; and, FIG. 10 is a sectional view of the reusable casing of FIGS. 6–8.

Referring principally to FIGS. 2 and 4 as regards features of the projectile 110, and principally to FIGS. 7 and 9 as regards features of the projectile 210, the projectiles 110, 210 have forwardly extending nose portions 112, 212 and rearwardly extending portions 114, 214 that are substantially symmetrical about imaginary center axes that are designated by arrows 101, 201, respectively. Central portions 116, 216 are interposed between the forwardly extending portions 112, 212 and the rearwardly extending portions 114, 214, respectively.

Outer surfaces of the projectiles 110, 210 are defined 1) by blunt, forwardly extending outer surfaces 122, 222 of the nose portions 112, 212; 2) by rearwardly extending outer surfaces 124, 224 of the rearwardly extending portions 114, 214; 3) by substantially uniform diameter outer surfaces 126, 226 that extend circumferentially about the central portions 116, 216; and 4) by radially extending shoulder surfaces 128, 228 that form stepped transitions between the rearwardly extending outer surfaces 124, 224 and the central portion outer surfaces 126, 226, respectively.

Referring principally to FIGS. 4 and 9, the projectiles 110, 210 have hollow interiors that define substantially cylindrical, rearwardly opening chambers 130, 230 that extend substantially coaxially about the center axes 101, 201 through the rearwardly extending portions 114, 214 and into the central portions 116, 216. Tapered end portions 132, 232 of the rearwardly extending outer surfaces 124, 224 extend about rearwardly-facing openings 134, 234 of the chambers 130, 230, respectively.

The rearwardly extending outer surfaces 124, 224 define substantially cylindrical surface portions 136, 236 that extend substantially symmetrically about the center axes 101, 201, respectively. The cylindrical surface portions 136, 236 join at their forward ends with the radially extending shoulder surfaces 128, 228, and at their rearward ends with tapered surfaces 138, 238 that are of truncated conical configuration. The tapered surfaces 138, 238 connect at their forward ends with the cylindrical surface portions 136, 236, and connect along at their rearward ends with the tapered end portions 132, 232, respectively.

Figure 3:
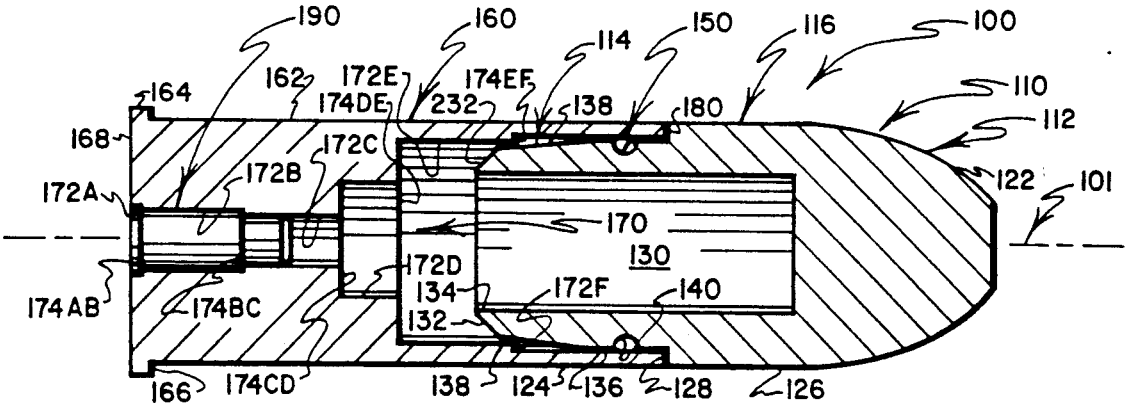
FIG. 3 is a sectional view as seen from a plane indicated by a line 3—3 in FIG. 1, and showing the reusable projectile in assembled relationship with the reusable casing.

Circumferentially extending grooves 140, 240 for receiving the O-rings 150, 250 are formed in the substantially cylindrical surface portions 136, 236 of the rearwardly extending outer surfaces 124, 224. The grooves 140, 240 are generally semi-circular when viewed in cross section, as is best seen in FIGS. 3 and 4, and in FIGS. 8 and 9, respectively.

The O-rings 150, 250 are commercially available O-rings that are sized so that the resilient material from which they are formed needs to be slightly elastically stretched in order to slide the O-rings 150, 250 along the generally cylindrical surface portions 136, 236 so that the O-rings 150, 250 can be moved into and seated within the grooves 140, 240, respectively. The O-rings 150, 250 serve the very important function of a "resilient connecting medium" that is tightly clamped between coaxially extending surfaces 136, 236 and 172F, 272F of the projectiles 110, 210 and the casings 160, 260 to releasably retain the projectiles 110, 210 and the casings 160, 260 in their duly "assembled" configurations.

Referring to FIGS. 6–9, a pair of axially spaced circumferentially extending grooves 242, 244 for receiving O-rings 252, 254 are formed in the substantially cylindrical surface 226 of the projectile 210. As is best seen in FIG. 9, the grooves 242, 244 are generally semicircular in cross-section and serve to seat the O-rings 252, 254.

The O-rings 252, 254 are commercially available O-rings that are sized so that the resilient material from which they are formed needs to be slightly elastically stretched in order to slide the O-rings 252, 254 along the generally cylindrical surface 226 so that the O-rings 252, 254 can be moved into and seated within the grooves 242, 244, respectively. The O-rings 252, 254 serve as "spin bands" to resiliently engage such rifling formations as typically extend helically along the lengths of interior surfaces of the barrels of such weapons as 40 mm grenade launchers.

Figure 5:
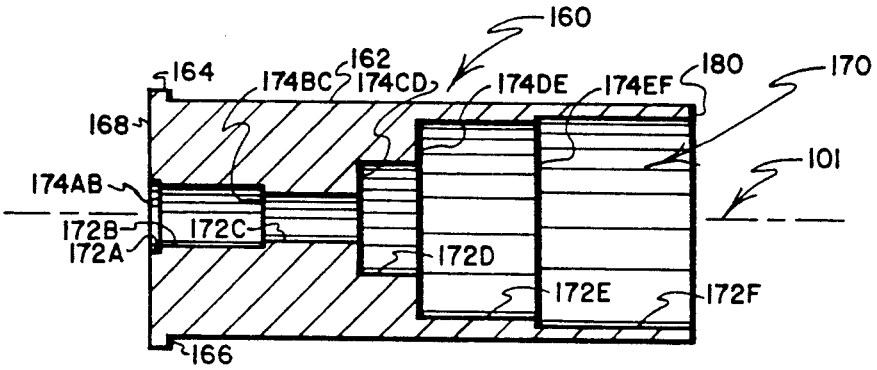
FIG. 5 is a sectional view of the reusable casing.
Figure 10:
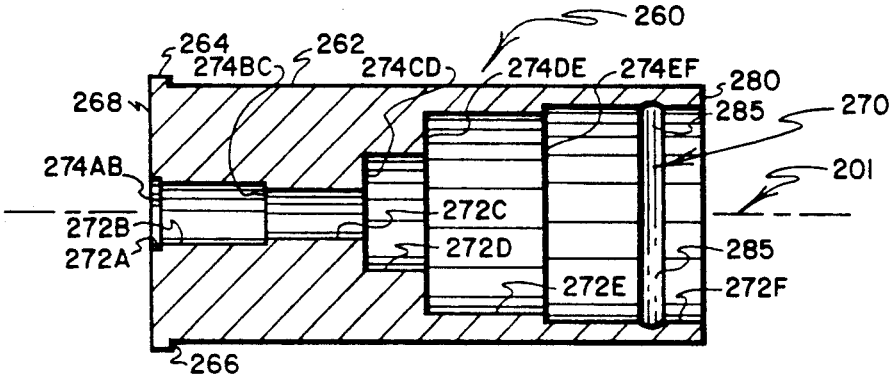

Referring principally to FIGS. 2 and 5 as regards features of the casing 160, and principally to FIGS. 7 and 10 as regards features of the casing 260, the casings 160, 260 have generally cylindrical outer surfaces portions 162, 262 that extend substantially symmetrically about the imaginary center axes 101, 201, respectively, for the majority of the lengths of the casings 160, 260. At the rearward ends of the casings 160, 260, radially outwardly extending flanges 164, 264 of greater diameter than the outer surface portions 162, 262 define radially extending shoulder surfaces 166, 266 that connect with the outer surface portions 162, 262. Substantially flat end surfaces 168, 268 are defined at the rearward ends of the casings 160, 260.

Referring principally to FIGS. 5 and 10, the casings 160, 260 have hollow interiors 170, 270 that are defined by a series of generally cylindrical wall portions which are interconnected by a series of radially extending shoulder surfaces, all of which extend substantially concentrically about the center axes 101, 201, respectively. Cylindrical wall portions that contribute to the definition of the hollow interiors 170, 270 are designated by the numerals 172A, 172B, 172C, 172D, 172E, 172F and 272A, 272B, 272C, 272D, 272E, 272F, respectively. Shoulder surfaces that interconnect the various cylindrical wall portions of the hollow interiors are designated by the numerals 174AB, 174BC, 174CD, 174DE, 174EF and 274AB, 274BC, 274CD, 274DE, 274EF, respectively.

The hollow interiors 170, 270 open through the flat end surfaces 168, 268 at the rearward end of the casings 160, 260, respectively, and through flat end surfaces 180, 280 that define the forward ends of the casings 160, 260, respectively. A shallow, radially-inwardly facing groove 285 is formed in the cylindrical wall portion 272F of the casing 260 for receiving radially outermost portions of the O-ring 250 (see FIG. 8); however, the groove 285 is "optional," is provided only to assist the O-ring 250 in releasably retaining the casing 260 in assembled relationship with the projectile 210, can be made deeper if desired, or can be eliminated if desired. While no corresponding groove is formed in the corresponding cylindrical wall portion 172F of the casing 160, it will be understood that a shallow groove (not shown) that is identical to the shallow groove 285 can be provided in the cylindrical wall portion 172F for receiving outermost portions of the O-ring 150 to help maintain the assembled configuration of the reusable round 100, or that a deeper groove (not shown) alternatively can be provided as may be desired.

Referring principally to FIGS. 2 and 7, the propellant cartridges 190, 290 may take the form of commercially available "blank" rounds, for example 0.38 blank rounds or 0.357 blank rounds. The propellant cartridges 190, 290 can be of a reloadable type, or can be used once and discarded after being fired. In preferred practice, however, the "blank" propellant cartridges 190, 290 are not of "standard" configuration but rather are modified forms of commercially available "blank" rounds which snugly fit into the interior portions 172A, 172B, 172C and 272A, 272B, 272C of the chambers 170, 270 that cooperate with their associated shoulder formations 174AB, 174BC and 274AB, 274BC to receive the "blank" propellant cartridges 190, 290 in a snug fit, but are arranged and configured so that commercially available live rounds such as standard 0.38 or 0.375 cartridges cannot be received and properly seated therein.

As those who are skilled in the art readily will understand, the safety precaution of sizing the hollow interiors 170, 270 so that only specially configured blank cartridges 190, 290 can be received and seated therein is a well-known precaution to take in conjunction with devices that need to employ a blank propellant cartridge but which could be rendered unduly dangerous if conventional live ammunition also could be received and seated therein. Thus, the "dimensioned to exclude live ammunition" safety precaution that preferably is utilized to prevent the installation of conventional live ammunition into the casings 160, 260 is well known and is recommended for use herewith.

Figure 6:
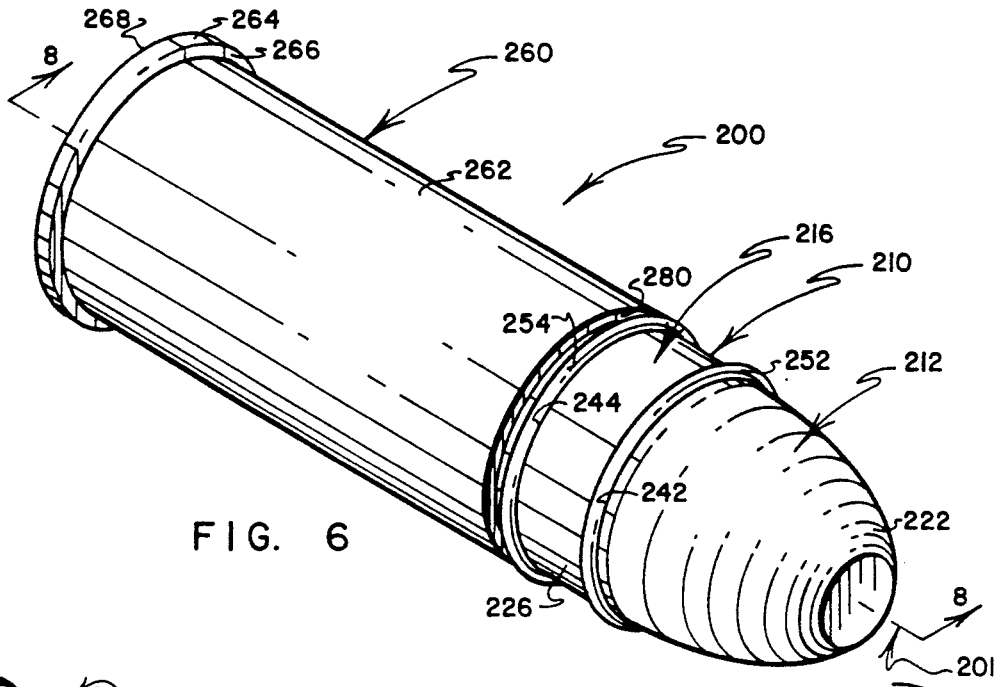
FIG. 6 is a perspective view of an alternate embodiment of round of reusable training ammunition that embodies features of the preferred practice of the present invention.

To assemble the aforedescribed components (shown in FIGS. 2 and 7) to form the reusable training rounds 100, 200 that are depicted in FIGS. 1 and 6, only a few relatively simple assembly steps are required. The propellant cartridges 190, 290, respectively, are pressed into and seated within the passage portions 172A, 172B, 172C (see FIG. 3) and 272A, 272B, 272C (see FIG. 8). The O-rings 150, 250 are slided along the surfaces 136, 236 to positions where they are permitted to resiliently seat themselves within the grooves 150, 250 (see FIGS. 4 and 9), respectively. The O-rings 252, 254 are slided along the surface 226 to positions where they are permitted to resilient seat themselves within the grooves 242, 244 (see FIGS. 8 and 9). These steps provide projectile and casing sub-assemblies that can be manually assembled as by inserting rear portions 114, 214 of the projectiles 110, 210 into the forwardly opening chambers 170, 270 of the casings 160, 260. When fully assembled, the front end walls 180, 280 of the casings 160, 260 abuttingly engage the shoulders 128, 228 of the projectiles 110, 210, respectively.

During the course of inserting rearwardly projecting portions of the projectiles 110, 210 into the forwardly opening chambers 170, 270 of the casings 160, 260, the front end surfaces 180, 280 of the casings 160, 260 are brought into abutting engagement with portions of the O-rings 150, 250 that project out of the grooves 140, 240. To complete the assembly movement of the casings 160, 260 and the projectiles 110, 210, it is necessary to increase the assembly force that is being applied to effect relative axial movement of the components 110, 210 and 160, 260.

As assembly force is increased, the material of the O-rings 150, 250 is caused 1) to resiliently change its cross-section as it slides into the interiors of the casings 160, 260, and 2) to be compressed radially inwardly by virtue of its engagement with the interior wall portions 172F, 272F of the casing chambers 170, 270. As the casings 160, 260 progressively force material of the O-rings 150, 250 into the interiors of the chambers 170, 270, progressively less material of the O-rings 150, 250 is left to block the path of relative movement of the casings 160, 260 across the location of the groove-carried O-rings 150, 250; and, there comes a time when the relatively large assembly force that is being applied to the casings 160, 260 and the projectiles 110, 210 overwhelms the diminishing resistance that is offered by the progressively diminishing amount of O-ring material that blocks the path of movement of the casings 160, 260 axially about the projectile portions 136, 236.

When resistance to relative axial movement of the casings 160, 260 and the projectiles 110, 210 suddenly abates, the substantial assembly force that still is being applied to the components 110, 210 and 160, 260 causes the casings 160, 260 to surge axially relative to the projectiles 110, 210 to a final assembly position wherein the end walls 180, 280 of the casings 160, 260 firmly abut tingly engage the shoulders 128, 228 of the projectiles 110, 210. These "final assembly" movements are, in effect, of a "snap-action" character and give a person who is manually assembling the components 110, 210 and 160, 260 very much the same kind of "feel" that is provided by when components are securely "snap-connected" by any of a variety of commercially available snap-action connectors.

Figure 8:
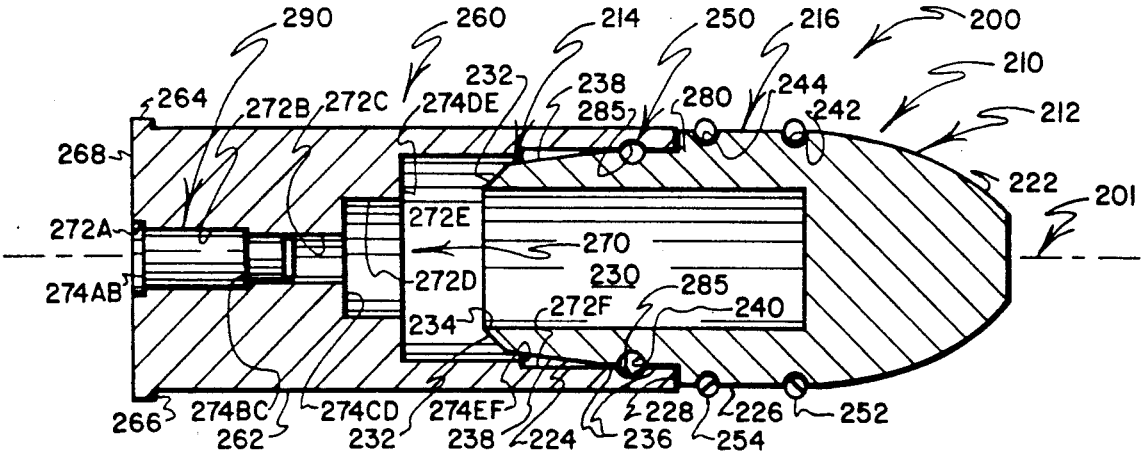
FIG. 8 is a sectional view as seen from a plane indicated by a line 8—8 in FIG. 6, and showing the reusable projectile in assembled relationship with the reusable casing.

Referring to FIGS. 3 and 8, when the training rounds 100, 200 are duly assembled, the chamber 130 is axially aligned and communicates with the chamber 170, and the chamber 230 is axially aligned and communicates with the chamber 270. When the propellant cartridges 190, 290 are fired, they discharge into the communicating chambers 130, 170 and 230, 270, cause the projectiles 110, 210 to immediately disconnect from the casings 160, 260, and cause the projectiles 110, 210 to be launched through the barrels of the guns that fired the propellant cartridges 190, 290. Depending on the magnitude of the charges that is carried by the propellant cartridges 190, 290, flight characteristics of relatively short to relatively long range "live rounds" effectively can be simulated.

Once the training rounds 100, 200 have been fired and the projectiles 110, 210 have been recovered, reloading and reassembling the training rounds 100, 200 for reuse is a simple matter of replacing the spent propellant cartridges 190, 290, and of reconnecting the projectiles 110, 210 and the casings 160, 260 in the manner that has been described previously.

To summarize, in preferred practice the present invention provides a reusable training round assembly that includes a reusable hollow projectile, a reusable hollow casing, and a reusable resilient retaining medium such as an O-ring. The casing is configured to be inserted into the chamber of a gun and retained therein when the round is fired. The projectile is configured to slip-fit within the barrel of a gun so that, when the assembled round is fired, the projectile is launched through the barrel. Propellant is provided by a reloadable or disposable blank-type cartridge that is inserted into an end opening of the hollow casing for discharging through the hollow casing to apply force directly to the projectile when fired. A snap-together type of releasable connection preferably is established between the casing and the projectile 1) by providing the casing and the projectile with coaxially extending surfaces that are brought into juxtaposed relationship during assembly of the casing and the projectile, and 2) by positioning a resilient connecting member to be tightly clamped between the juxtaposed surfaces just as assembly of the round is completed. In preferred practice, the casing and the projectile are machined from aluminum, and a groove-mounted O-ring serves as the connecting member. One or more additional O-rings may be carried in circumferentially extending grooves formed in a generally cylindrical outer surface portion of the projectile for engaging such rifling formations as may be provided within the barrel of a gun to impart spin to a fired projectile. The O-rings are retained in their mounting grooves during firings of the round, travel with the reusable projectile, and typically survive many firings before requiring replacement.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A reusable training round assembled from a reusable casing and a reusable projectile for being inserted into a chamber end region of a gun barrel to be fired so as to shoot the reusable projectile through the gun barrel for discharge from the barrel along a desired trajectory while retaining the reusable casing within the chamber end region of the gun barrel, comprising:

a) reusable projectile means including an elongate projectile formed from relatively rigid, shock and impact resistant material that defines 1) a front region of generally blunt-nosed shape, 2) a rear region, and 3) a central region that is characterized by spaced front and rear portions which are connected, respectively, to the front and rear regions, with the central region having at least a portion thereof that is of substantially constant diameter, with the structure of each of said front, central and rear regions being configured to extend substantially symmetrically about an imaginary axis that runs substantially centrally through the front, central and rear regions in forward and rearward directions, and with the elongate projectile having portions thereof that are hollow so as define an empty interior substantially cylindrical chamber portion that extends substantially symmetrically about said axis over a major portion of said axis and that opens rearwardly through the rear region of the projectile;

b) reusable casing means including an elongate casing formed from relatively rigid, shock and impact resistant material that defines 1) a generally tubular, relatively thin walled forward region that extends about a forwardly-opening chamber portion, and 2) a generally tubular, relatively thick walled rearward region that has a passage formed substantially centrally therethrough, with the structure of each of said forward and rearward regions being configured to extend substantially symmetrically about said axis, and with said forwardly-opening chamber portion and said passage being in communication with each other and extending substantially symmetrically about said axis;

c) connection means for releasably retaining the projectile means and the casing means in an assembled configuration so that the assembly thereof can be chambered in a gun barrel, with the connection means including a first surface defined at least in part by the forward region of the casing, and a second surface defined at least in part by the rear region of the projectile, said second surface having a diameter which is less than the diameter of said central region of said projectile and a radially extending shoulder between said second surface and a surface of said central region, said shoulder being in contact with a front end wall of the casing, with the first and second surfaces being configured and arranged to extend substantially coaxially about said axis in spaced, juxtaposed relationship in said assembled configuration, and with the connection means further including compressible means formed from a ring of resilient material being compressed between and tightly clamped between said spaced, juxtaposed first and second surfaces for releasably retaining the projectile and the casing in said assembled configuration, with said ring of resilient material located adjacent said shoulder, with the compression and tight clamping of the ring of resilient material being effected by applying assembly force of increasing magnitude to the projectile and to the casing in directions extending generally parallel to said imaginary axis for moving the projectile and the casing relatively toward and into said assembled configuration, and with the increasing magnitude of the assembly force reaching a point when completion of the compression and tight clamping of the ring of resilient material that is needed to effect final relative movement of the projectile and the casing to said assembled configuration is completed relatively suddenly such that the projectile and the casing are caused to effect said final relative movement with suddenness such that a "snap action" type of "feel" is provided to a person who manually supplies said assembly force;

d) with the rearwardly-opening chamber portion of the projectile and the forwardly-opening chamber portion of the casing defining hollow interiors that communicate and cooperate to define a closed chamber; and, e) propellant means including a replaceable propellant cartridge fitted into said passage for being fired to explosively discharge propellant gas into said chamber to shoot the projectile through said gun barrel.

2. The reusable training round of claim 1 wherein the ring of resilient material includes an endless band of resilient material that is seated in a groove that is formed in at least a said selected one of said first and second surfaces.

3. The reusable training round of claim 2 wherein the endless band of resilient material includes a commercially available O-ring that is seated in said groove.

4. The reusable training round of claim 3 wherein said groove is of generally semi-circular configuration when viewed in cross-section.

5. The reusable training round of claim 2 wherein the endless band of resilient material includes an O-ring that is resiliently seated in said groove so as to be retained therein for travel with the projectile when the projectile is shot through the gun barrel, with the material from which the O-ring is formed being sufficiently resilient and durable to enable the O-ring to survive a plurality of projectile firings before requiring replacement.

6. The reusable training round of claim 1 wherein the projectile is formed of aluminum.

7. The reusable training round of claim 1 wherein the casing is formed of aluminum.

8. The reusable training round of claim 1 additionally including spin band means comprising at least one endless ring of resilient material that is seated in at least one circumferentially extending groove formed in the projectile means and extending substantially concentrically about said axis for engaging rifling within the barrel of a gun to impart spin to the projectile as the projectile is shot through the barrel.

9. The reusable training round of claim 8 wherein the spin band means is a commercially available O-ring.

10. The reusable training round of claim 8 wherein said spin band means includes a pair of endless resilient rings that are seated in axially spaced grooves that are formed in the periphery of the projectile means that extend substantially concentrically about the center axis.

11. The reusable training round of claim 10 wherein the spin band means comprise a pair of commercially available O-rings that travel with the reusable projectile when the projectile is shot through the barrel of a gun, with the O-rings being formed from sufficiently resilient and durable material to enable the O-rings to typically survive a plurality of projectile firings before requiring replacement.

* * * * *